US007624915B2

(12) United States Patent
Dembowiak et al.

(10) Patent No.: US 7,624,915 B2
(45) Date of Patent: Dec. 1, 2009

(54) RECYCLING CENTER

(75) Inventors: Casey M. Dembowiak, Greenfield, WI (US); Edmund A. Malczewski, Milwaukee, WI (US); Mark D. Arnold, Dixon, IL (US)

(73) Assignee: Riverwest Engineering & Design, Inc., West Allis, WI (US)

( * ) Notice: Subject to any disclaimer, the term of this patent is extended or adjusted under 35 U.S.C. 154(b) by 0 days.

(21) Appl. No.: 12/025,298

(22) Filed: Feb. 4, 2008

(65) Prior Publication Data

US 2009/0194579 A1 Aug. 6, 2009

(51) Int. Cl.
*A47G 29/12* (2006.01)

(52) U.S. Cl. ..... 232/43.2; 220/495.08; 220/908.1

(58) Field of Classification Search ..... 232/43.2, 232/43.1, 30–32; 220/908.1, 908, 665, 495.06, 220/495.08, 495.11
See application file for complete search history.

(56) References Cited

U.S. PATENT DOCUMENTS

| | | | | |
|---|---|---|---|---|
| 63,383 | A | | 4/1867 | Hanks |
| 100,123 | A | | 2/1870 | Crofoot |
| 102,616 | A | | 5/1870 | Sweigert |
| 447,686 | A | | 3/1891 | Holladay |
| 653,035 | A | | 7/1900 | Noble |
| 1,022,862 | A | | 4/1912 | McMillen |
| 2,125,122 | A | * | 7/1938 | Mongiello ..... 220/825 |
| 2,421,221 | A | * | 5/1947 | Rothe ..... 232/30 |
| 2,470,977 | A | | 5/1949 | Chidsey, Jr. |
| 3,204,866 | A | * | 9/1965 | Brighton et al. ..... 232/43.2 |
| 3,314,632 | A | * | 4/1967 | Freuler ..... 248/101 |
| 3,451,582 | A | * | 6/1969 | Morgan ..... 220/7 |
| 3,502,291 | A | | 3/1970 | Ackerman et al. |
| 3,556,395 | A | * | 1/1971 | Herman ..... 232/43.2 |
| 3,659,816 | A | | 5/1972 | Wilson |
| 3,866,824 | A | * | 2/1975 | Lewis ..... 232/43.2 |
| 3,948,474 | A | | 4/1976 | Pomroy |
| 4,363,438 | A | * | 12/1982 | Connor ..... 232/30 |
| 4,577,778 | A | * | 3/1986 | Kim ..... 220/495.07 |
| 4,593,873 | A | | 6/1986 | Nelson |
| 4,613,104 | A | | 9/1986 | Garrott |
| 4,697,771 | A | | 10/1987 | Majors |
| 4,711,367 | A | | 12/1987 | Albertson |
| 4,723,741 | A | | 2/1988 | Doering |
| 4,793,628 | A | | 12/1988 | Haley, Sr. |
| D304,873 | S | | 11/1989 | Ruehland |
| 4,953,815 | A | | 9/1990 | Beymer et al. |
| 5,076,458 | A | | 12/1991 | Weiner et al. |
| D352,581 | S | | 11/1994 | Fredericks |
| 5,360,189 | A | | 11/1994 | Hart |
| 5,390,813 | A | | 2/1995 | Anderson et al. |
| 5,398,838 | A | | 3/1995 | Dosunmu |

(Continued)

*Primary Examiner*—William L. Miller
(74) *Attorney, Agent, or Firm*—Boyle Fredrickson, S.C.

(57) ABSTRACT

A recycling center receivable on a supporting surface is provided. The recycling center includes first and second sidewalls. Each sidewall has a forward edge, a rearward edge, an upper edge and an inner surface such that the inner surfaces of the sidewalls define a recycle receiving chamber. A lid extends between the upper edges of the first and second sidewalls. The lid has an aperture therethrough. A door is pivotably connected to the forward edge of the first sidewall. The door is movable between a first closed position and a second open position allowing access to the recycle receiving chamber. The door includes a transparent portion to allow an individual to view the recycle receiving chamber therethrough.

15 Claims, 6 Drawing Sheets

U.S. PATENT DOCUMENTS

| | | | | |
|---|---|---|---|---|
| D358,012 | S | 5/1995 | Faulkner et al. | |
| 5,411,229 | A | 5/1995 | Hoefkes | |
| 5,570,862 | A | 11/1996 | Nugent | |
| 5,799,908 | A | 9/1998 | Downs | |
| 5,819,974 | A | 10/1998 | Caldwell | |
| 5,887,696 | A | 3/1999 | Goetz | |
| D423,168 | S | 4/2000 | Studstill | |
| 6,076,782 | A | 6/2000 | Alderman | |
| 6,116,549 | A | 9/2000 | Santa Cruz et al. | |
| 6,241,115 | B1 * | 6/2001 | Delmerico et al. | 220/495.06 |
| 6,334,593 | B2 | 1/2002 | Inoue | |
| 6,491,264 | B1 | 12/2002 | Valesquez | |
| 6,550,792 | B1 | 4/2003 | Salmon et al. | |
| D481,509 | S | 10/2003 | Perelli | |
| 6,676,141 | B1 | 1/2004 | Hadley | |
| 7,032,868 | B2 | 4/2006 | Mutert | |
| D521,204 | S | 5/2006 | Lauer | |
| D531,373 | S | 10/2006 | DesLaurier | |
| 7,188,745 | B2 | 3/2007 | Schermel | |
| D546,521 | S | 7/2007 | Mutert | |
| D552,320 | S | 10/2007 | Presnell et al. | |
| 2006/0196879 | A1 * | 9/2006 | Chochinov et al. | 220/665 |

* cited by examiner

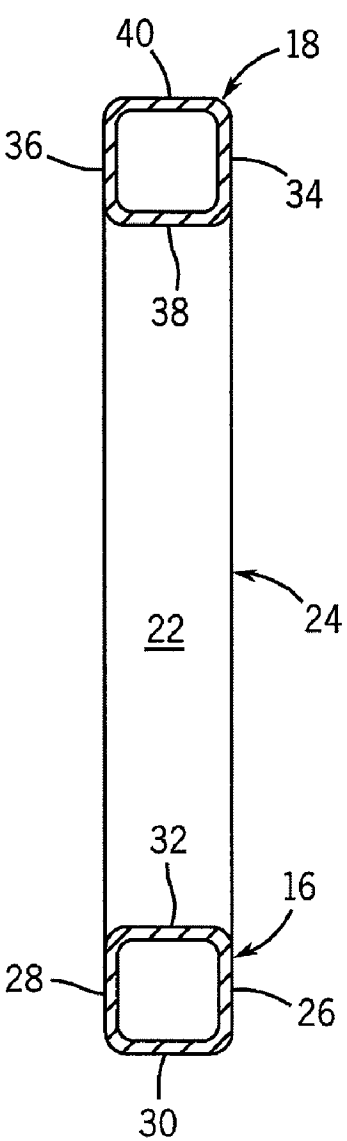
FIG. 1C
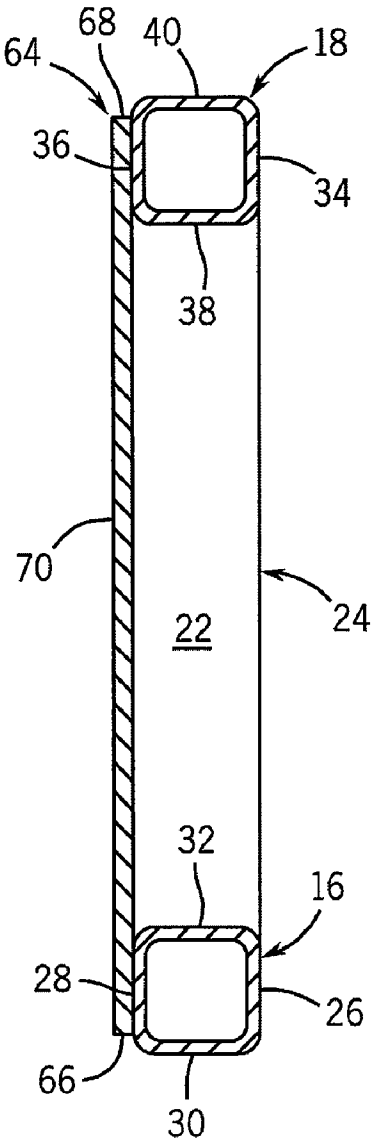

RECYCLING CENTER

FIELD OF THE INVENTION

This invention relates generally to containers, and in particular, to a modular recycling center that allows a user to visually inspect the interior thereof.

BACKGROUND AND SUMMARY OF THE INVENTION

As is known, the United States produces over 250 million tons of municipal solid waste each year. This number represents approximately 4.6 pounds of waste per person per day. A large portion of this waste is hauled away in garbage trucks and packed into sanitary landfills. As a result, landfilling has become the number one method of disposing trash in the United States. However, most of the material disposed of in landfills is recyclable. Hence, in order to reduce the volume of waste disposed of in landfills, Americans have turned to recycling. It has be found that recycling benefits the environment at every stage in the life cycle of a consumer product, from the raw material used to make the product, to the final method of disposal. In order to encourage recycling, many public facilities have start to position recycling bins throughout their premises.

While functional for their intended purpose, these prior recycling bins have certain shortcomings making them unsuitable for use at public facilities. For example, potential terrorist attacks in public places have become an important issue in homeland security. It can be appreciated that since these types of recycling bins are constructed from non-transparent material such a steel or the like, a terrorist may place an item such as an explosive device or a biological agent within the recycling bin without detection. It can be appreciate that the damage caused to the public by such a terrorist attack may be significant.

Sholinder, U.S. Pat. No. 7,198,166 discloses an example of a prior recycling bin. The bin discloses in the '166 patent includes a rigid modular container having a floor and an opposite lid. Opposite rigid rectilinearly-shaped first and second panels are provided between the floor and lid and oppositely disposed rigid rectilinearly-shaped third and fourth panels extending from and between the first and second panels. The panels are removably mounted to the floor. The side edges of adjacent panels are removably mounted to each other as by bolting so that the side edges of the third and fourth panels abut the side edges of the first and second panels. Fastener bracing means such as bolt bracing are mounted to the side edges of the panels and are aligned between adjacent the panels so that fastener receiving apertures therethrough provide for rigid bracing of rigid fasteners such as bolts mounted through and between the fastener bracing means on the adjacent panels. Rigid fasteners such as bolts may be mounted through the fastener bracing means on the adjacent the panels. It is noted, however, that since the panels of the container in the '166 patent are not transparent, an explosive device or a biological agent may be placed in recycling bin without being visible to those individuals in the public facility. As a result, massive damage may result upon detonation or release.

Therefore, it is a primary object and feature of the present invention to provide a recycling center wherein the interior of the center may be visually inspected from the exterior thereof.

It is a further object and feature of the present invention to provide a recycling center that is simple to construct and easily expanded by a user.

It is a still further object and feature of the present invention to provide a recycling center that is inexpensive to manufacture and simple to utilize.

In accordance with the present invention, a recycling station receivable on a supporting surface is provided. The recycling station includes first and second sidewalls. Each sidewall includes a forward edge, a rearward edge, an upper edge and an inner surface such that the inner surfaces of the first and second sidewalls define a recycle receiving chamber. A lid is positioned between the upper edges of the first and second sidewalls. The lid has an aperture therethrough. A door is pivotably connected to the forward edge of the first sidewall. The door is movable between a first closed position and a second open position allowing access to the recycle receiving chamber. The door includes a transparent portion to allow an individual to view the recycle receiving chamber therethrough.

The first sidewall may include a panel having a transparent portion and the second sidewall may also include a panel having a transparent portion. The recycling station may have a rear wall that includes a panel having a transparent portion. Indicia may be provided on the first sidewall.

A bag support is slidably mounted within recycle receiving chamber. The bag support is movable between a first retracted position wherein the bag support in within the recycle receiving chamber and an extended position wherein at least a portion of the bag support projects from the recycle receiving chamber. The bag support includes a first rail slidably mounted to a first sidewall and a second rail slidably mounted to a second sidewall. The first rail has a forward end and a rear end, and the second rail has a forward end and a rear end. The bag support also includes a forward cross rail interconnecting the forward ends of the first and second rails. A bag support bar has a first end interconnected to the forward cross rail at a location adjacent the first rail and a second end interconnected to the forward cross rail at a location adjacent the second rail. The first and second ends of the bag support bar are generally C-shaped. The bag support bar and the forward cross rail lie in a common plane at an acute angle to the supporting surface.

In accordance with a further aspect of the present invention, a recycling station receivable on a supporting surface is provided. The recycling station includes a housing having first and second sidewalls and defining a recycle receiving chamber therein. A door is pivotably connected to the housing. The door is movable between a first closed position and a second open position allowing access to the recycle receiving chamber. A bag support is slidably mounted within recycle receiving chamber. The bag support is movable between a retracted position wherein the bag support in within the recycle receiving chamber and an extended position wherein at least a portion of the bag support project from the recycle receiving chamber.

The door includes a transparent portion that allows an individual to view the recycle receiving chamber therethrough. The housing may include indicia thereon. The bag support includes a first rail slidably mounted to a first sidewall and a second rail slidably mounted to a second sidewall. The first rail has a forward end and a rear end, and the second rail having a forward end and a rear end. The bag support further includes a forward cross rail interconnecting the forward ends of the first and second rails. A bag support bar has a first end interconnected to the forward cross rail at a location adjacent the first rail and a second end interconnected to the forward cross rail at a location adjacent the second rail. The first and second ends of the bag support bar are generally C-shaped.

The bag support bar and the forward cross rail lie in a common plane. The plane is at an acute angle to a vertical plane.

In accordance with a still further aspect of the present invention, a recycling station is provided. The recycling station includes a housing having first and second sidewalls and defining a recycle receiving chamber therein. A door is pivotably connected to the housing. The door is movable between a first closed position and a second open position allowing access to the recycle receiving chamber. A bag support slidably is mounted within recycle receiving chamber. The bag support includes a first rail slidably mounted to a first sidewall and a second rail slidably mounted to a second sidewall. The first rail has a forward end and a rear end, the second rail has a forward end and a rear end. A forward cross rail interconnects the forward ends of the first and second ends. A bag support bar has a first end interconnected to the forward cross rail at a location adjacent the first rail and a second end interconnected to the forward cross rail at a location adjacent the second rail. The first and second ends of the bag support bar are generally C-shaped. The bag support bar and the forward cross rail lie in a common plane. The plane is at an acute angle to a vertical plane. The door includes a transparent portion and the housing includes indicia thereon.

BRIEF DESCRIPTION OF THE DRAWINGS

The drawings furnished herewith illustrate a preferred construction of the present invention in which the above advantages and features are clearly disclosed as well as other which will be readily understood from the following description of the illustrated embodiment.

In the drawings:

FIG. 1C is a cross-sectional view of the recycling center of the present invention taken along line 1C-1C of FIG. 1B;

DETAILED DESCRIPTION OF THE DRAWINGS

Figure 1:
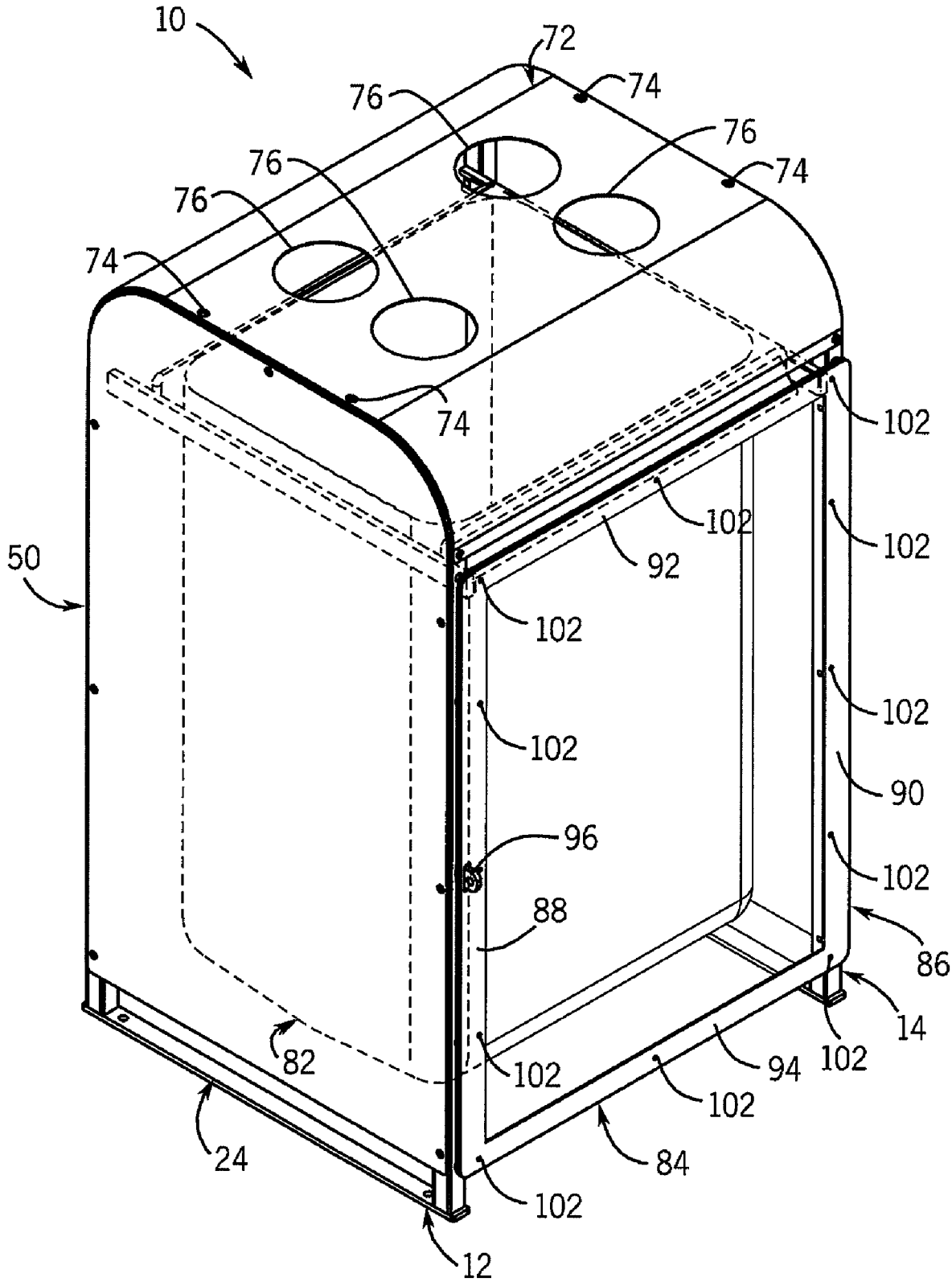
FIG. 1 is an isometric view of a recycling center in accordance with the present invention.

A recycling center in accordance with the present invention is generally designated by the reference numeral 10. As hereinafter described, it is intended for the recycling center 10 to be supported on a supporting surface 11 and to house a bag or the like for receiving recyclable materials therein. Recycling center 10 includes first and second generally U-shaped frame members 12 and 14, respectfully. It is noted that first and second frame members 12 and 14 are identical in structure. As such, the description hereinafter of first frame member 12 is understood to describe second frame member 14 as if fully described herein.

Figure 1B:
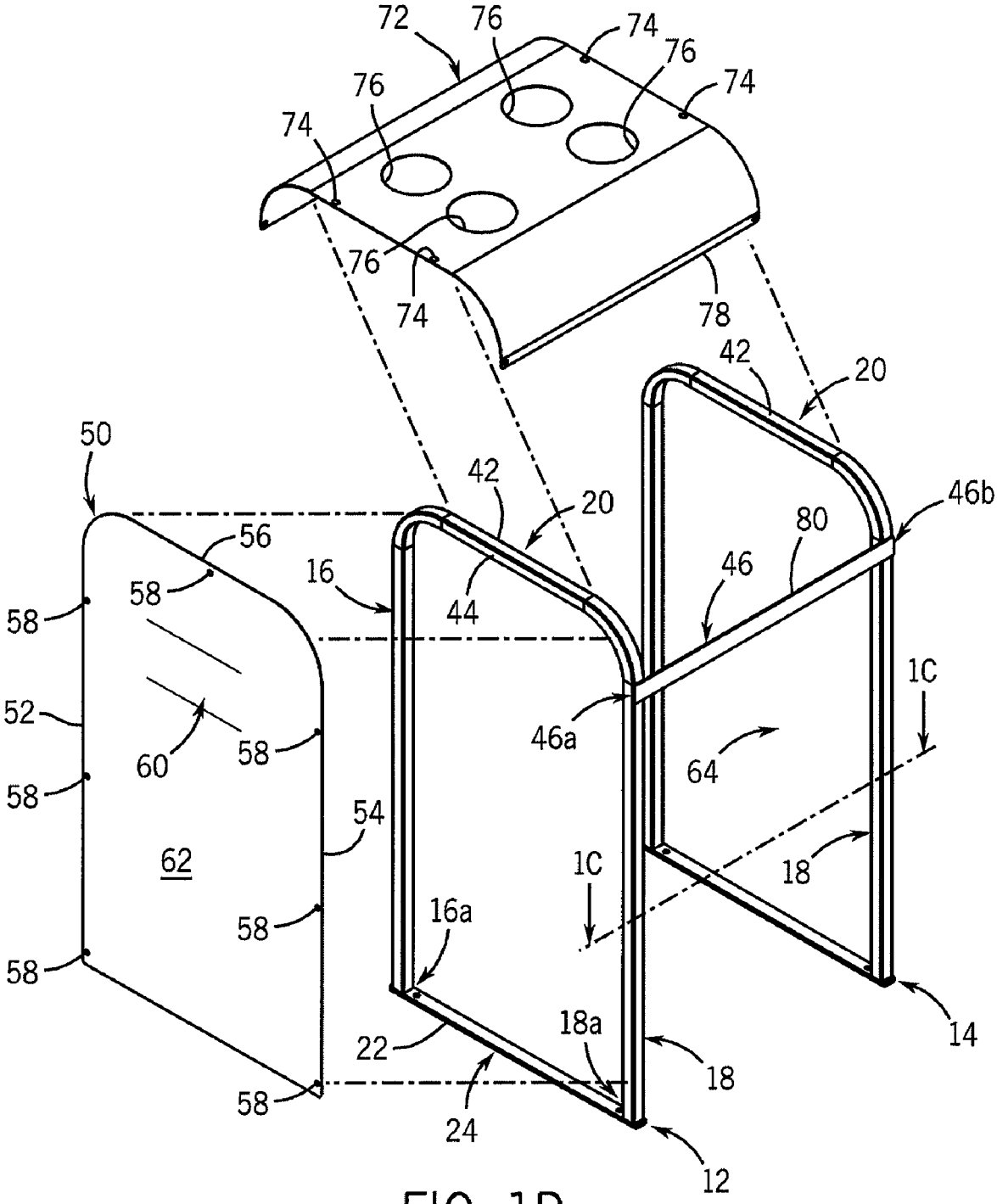
FIG. 1B is an exploded view of a portion of the recycling center of FIG. 1.

First frame member 12 is generally U-shaped and has a generally square cross section. As best seen in FIGS. 1B and 1C, first frame member 12 is defined by first and second spaced legs 16 and 18, respectfully. Upper ends of first and second legs 16 and 18, respectfully, of first frame member 12 are interconnected by upper cross leg 20. First and second legs 16 and 18 terminate at generally flat lower ends 16*a* and 18*a*, respectfully. Lower ends 16*a* and 18*a* of first and second legs 16 and 18, respectfully, of first frame member 12 are positioned on and interconnected to upper surface 22 of generally flat lower frame member 24.

First leg 16 of first frame member 12 includes a generally parallel inner and outer faces 26 and 28, respectively, interconnected by generally parallel sides 30 and 32, respectfully. Second leg 18 of first frame member 12 also includes inner and outer faces 34 and 36, respectively. Outer face 36 of second leg 18 of first frame member 12 lies in a common plane with outer face 28 of first leg 16 of first frame member 12. Inner and outer faces 34 and 36, respectively, of second leg 18 of first frame member 12 are interconnected by first and second generally parallel, spaced sides 38 and 40, respectively. Sides 30 and 40 of first and second legs 16 and 18, respectively, of first frame member 12 are interconnected by upper surface 42 of upper cross leg 20. Outer faces 28 and 36 of first and second legs 16 and 18, respectively, of first frame member 12 are interconnected by generally flat outer face 44 of cross leg 20.

First and second frame members 12 and 14, respectively, are interconnected by forward cross frame support 46. Forward cross frame support 46 includes a first end 46*a* affixed to side 40 of second leg 18 of first frame member 12 and a second end 46*b* affixed to side 40 of second leg 18 of second frame member 14. It is further contemplated to interconnect first legs 16 of first and second frame members 12 and 14, respectively, to add strength and rigidity to recycling center 10.

First panel 50 is interconnected to outer faces 28 and 36 of first and second legs 16 and 18, respectively, of first frame member 12 and to outer face 44 of upper cross leg 20 of first frame member 12. First panel 50 includes a first edge 52 aligned with side 30 of first leg 16 of first frame member 12; a second edge 54 aligned with side 40 of second leg 18 of first frame member 12; and upper edge 56 aligned with upper face 42 of upper cross leg 20 of first frame member 12. It is contemplated to interconnect first panel 50 to first frame member 20 with a plurality of spaced fasteners 58 such as rivets, screws, bolts or the like. It is further contemplated to provide indicia 16 on outer surface 62 of first panel 50 so as to allow a user to identify recycling center 10, as desired.

Second panel 64 is attached to outer faces 28 and 36 of first and second legs 16 and 18, respectively, of second frame member 14 and to outer face 44 of upper cross leg 20 of second frame member 18 by a plurality of spaced fasteners 58. Edge 66 of second panel 64 is aligned with outer face 30 of first leg 16 of second frame member 18; edge 68 of panel 64 is aligned with side 40 of second leg 18 of second frame member 14; and the upper edge of panel 64 is aligned with upper face 42 of upper cross leg 20 of second frame member 14. Outer surface 70 of second panel 64 may include indicia (not shown) to allow a user to identify recycling center 10, as desired.

Recycling center 10 may also include an optional rear panel (not shown) interconnected to first legs 16 of first and second frame members 12 and 14, respectively. In addition, recycling center 10 includes an upper panel 72 positioned on and interconnected to upper faces 42 of upper cross legs 20 of first and second frame members 12 and 14, respectively, by a plurality of fasteners 74 such as screws, bolts, and/or rivets. A plurality of apertures 76 extend through upper panel 72, for reasons hereinafter described. With upper panel 72 positioned on first and second frame members 12 and 14, respectively, forward edge 78 of upper panel 76 is adjacent upper edge 80 of forward cross support 46. As hereinafter described, upper panel 72 and first and second side panels 50 and 64, respectively, define a chamber for receiving a conventional bag 82 therein.

Figure 2:
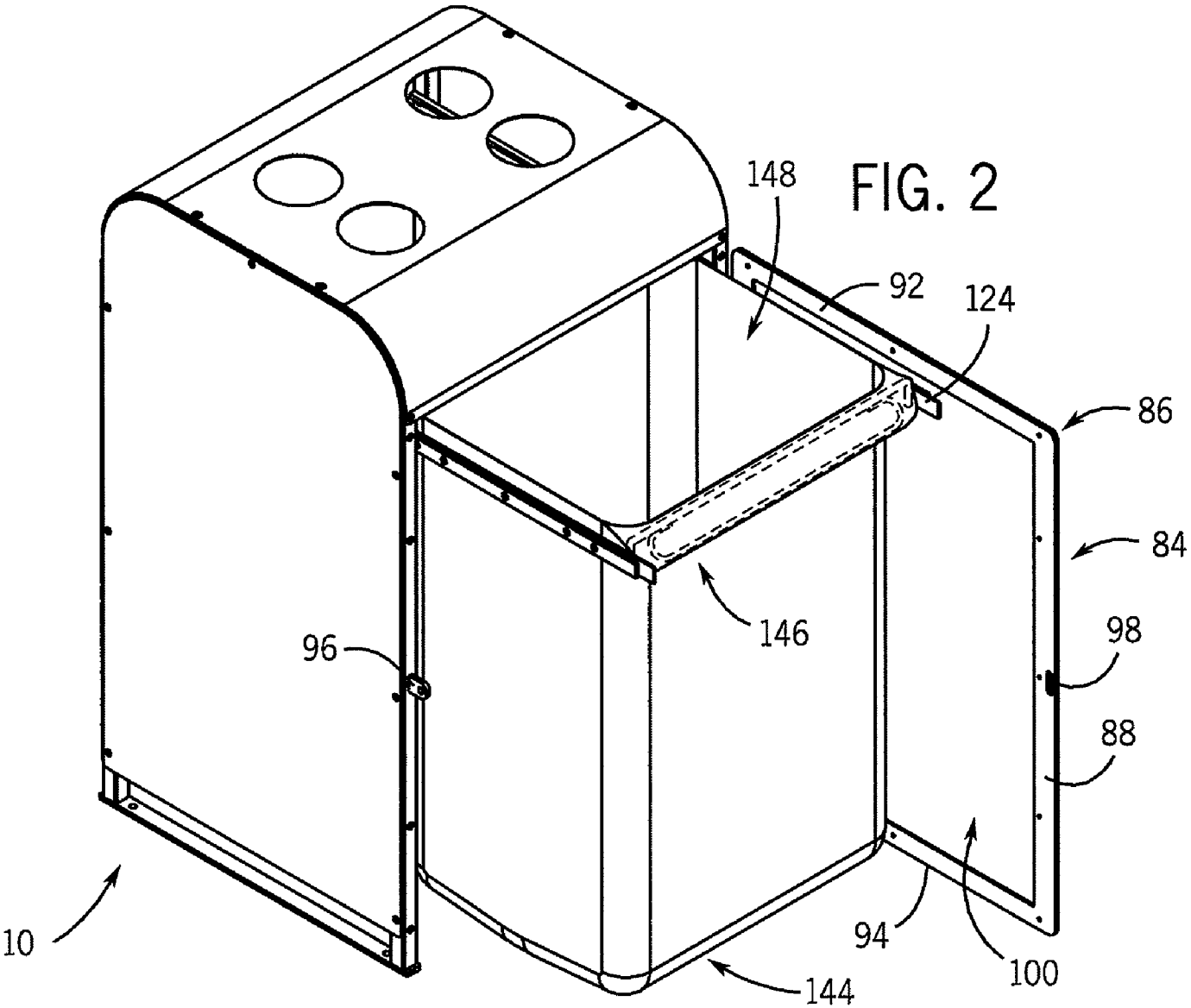
FIG. 2 is an isometric view of the recycling center of the present invention with the door of the recycling center in the open position.
Figure 3:
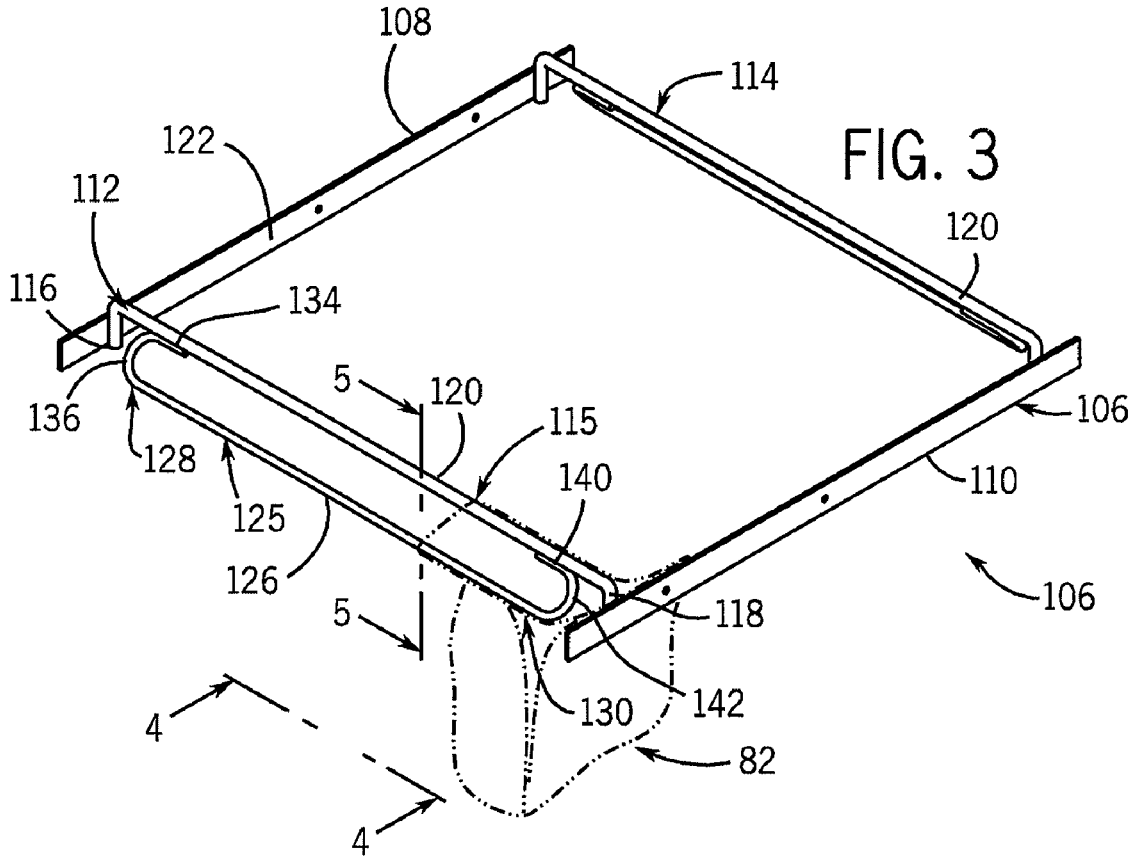
FIG. 3 is an isometric view of a bag holding slide for the recycling center of the present invention.
Figure 5:
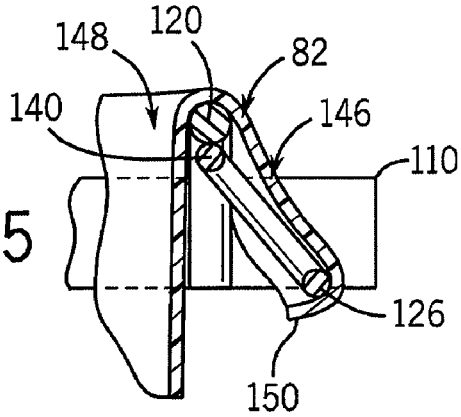
FIG. 5 is a cross-sectional view of the bag holding slide for the recycling center of the present invention taken along line 5-5 of FIG. 3.
Figure 4:
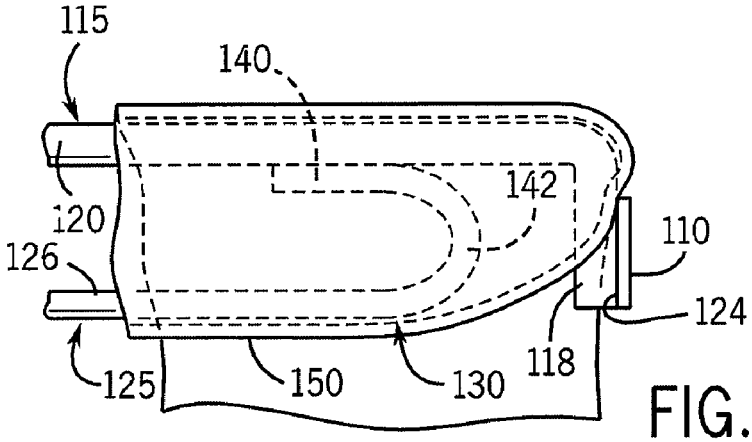
FIG. 4 is a cross-sectional view of the bag holding slide for the recycling center of the present invention taken along line 4-4 of FIG. 3.

Recycling center 10 further includes door 84 to provide access to the chamber therein. Door 84 includes a generally rectangular frame 86 having first and second side elements 88 and 90, respectively, interconnected by upper and lower frame elements 92 and 94, respectively. Side frame element 90 of frame 86 is interconnected to side 40 of second leg 18 of second frame member 14 by one or more hinges so as to allow door 84 to pivot between a closed position, FIG. 1, and an open position, FIG. 2. In order to maintain door 84 in a closed position, locking eye 96 may project from side 40 of second leg 18 of first frame element 12. Locking eye 96 is aligned with a corresponding slot 98 in side frame element 88 of frame 86 of door 84 such that with door 84 in the closed position, locking eye 96 projects through slot 98 in frame 86 of door 84. A locking bar of a conventional pad lock may be inserted through the eye of locking eye 96 to retain door 84 in its closed position.

Figure 6:
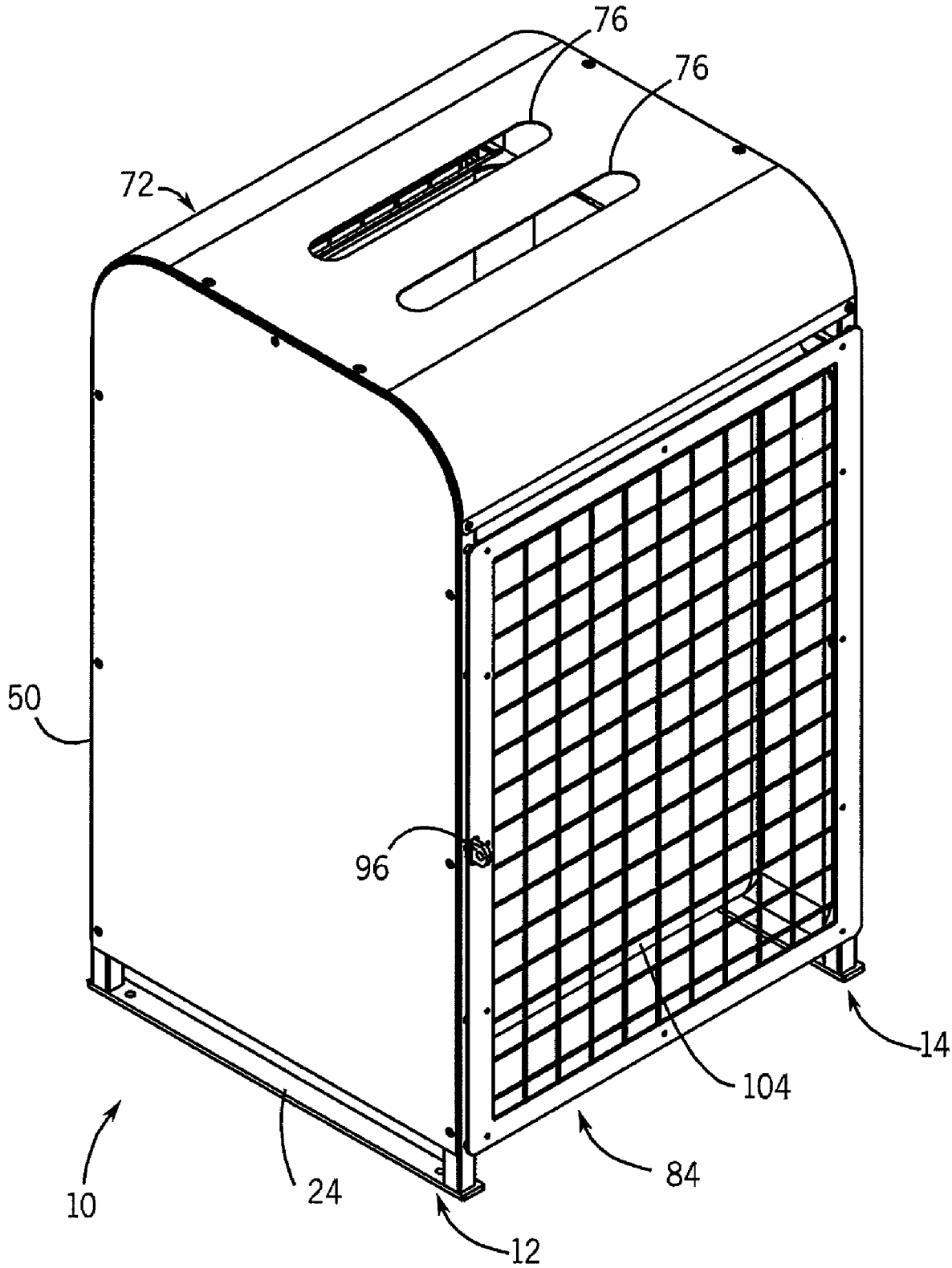
FIG. 6 is an isometric view of an alternate embodiment of a recycling center in accordance with the present invention.

Panel 100 may be positioned within the opening defined by frame 86 and interconnected to frame 86 and retained therein by a plurality of fasteners 102. It is intended for panel 100 to be transparent in order to allow the quick and easy inspection of the chamber defined by the interior of recycling center 10. Alternatively, as best seen in FIG. 6, it is contemplated to provide wire mesh 104 within the interior of frame 86 of door 84 so as to allow easy inspection of the interior of recycling center 10.

Referring to FIGS. 2-5, bag 82 is supported by bag slide 106. Bag slide 106 includes first and second side rails 108 and 110, respectively. First side rail 108 is telescopically and slidably received within a support bracket (not shown) mounted to inner faces 26 and 34 of first and second legs 16 and 18, respectively, of first frame member 12 adjacent the upper ends of first and second legs 16 and 18, respectively. Second side rail 110 is telescopically and slidably received within a support bracket (not shown) mounted to inner faces 26 and 34 of first and second legs 16 and 18, respectively, of second frame member 18 adjacent the upper ends of first and second legs 16 and 18, respectively. First and second slide rails 108 and 110, respectively, and hence bag slide 106, is movable between a retracted position, FIG. 1, wherein bag slide 106 is received entirely within the interior of the chamber defined by recycling center 10 and an extended position, FIG. 2, wherein bag slide 106 projects from the chamber within recycling center 10.

First and second side rails 108 and 110, respectively, are interconnected by a forward bag support 112 and a rear bag support 114. It is noted that forward and rear bag supports 112 and 114, respectively, are identical in structure. As such, the description hereinafter of forward bag support 112 is understood to describe rear bag support 114 as if fully described herein.

Forward bag support 112 includes a generally U-shaped member 115 having first and second legs 116 and 118, respectively, interconnected by an elongated rod 120 that spaces first and second side rails 108 and 110, respectfully. First leg 116 of member 115 is affixed to inner surface 122 of first side rail 108. Second leg 118 of member 115 is interconnected to inner surface 124 of second side rail 110. Forward bag support 112 further includes a bag retainer 125. Bag retainer 125 includes bar 126 extending along a longitudinal axis and having first and second opposite ends 128 and 130, respectively. Bar 126 is generally parallel to and positioned below and laterally spaced from rod 120. Bag retainer 125 includes a first mounting portion 134 that is generally parallel to bar 126 and is interconnected to rod 120. First mounting portion 134 is interconnected to bar 126 by a generally arcuate, concave portion 136. Bag retainer 125 further includes a second mounting portion 140 generally parallel to central bar 132 and interconnected to rod 120. Second mounting portion 140 of bag retainer 125 is interconnected to bar 126 by a generally arcuate, concave portion 142. Bar 126, concave portions 136 and 142 and first and second mounting portions 134 and 140, respectively, of bag retainer 125 lie in a common plane and at an acute angle to supporting surface 11.

In operation, bag 82, preferably transparent, is provided. As is conventional, bag 96 includes a closed bottom end 144 and an opposite open end 146. Open end 146 of bag 82 includes opening 148 defined by upper peripheral edge 150. A first portion of the upper edge 150 of bag 82 is pulled over rod 120 of forward bag support 112 and is wrapped around bag retainer 125 of forward bag support 112 such that concave portions 136 and 142 of bag retainer 125 retains bag 82 thereon. A second portion of the upper edge 150 of bag 82 is pulled over rod 120 of rear bag support 114 and is wrapped around bag retainer 125 of rear bag support 114 such that concave portions 136 and 142 of bag retainer 125 retains bag 82 thereon. With bag 82 mounted on forward bag support 112 and rear bag support 114, opening 148 in bag 82 is directed upwardly between first and second side rails 108 and 110, respectively, of bag slide 106. Thereafter, bag slide 106 is slid towards its retracted position such that opening 148 in bag 82 is axially aligned with openings 76 through upper panel 72 of recycling center 10. As such, any items to be recycled that are deposited in opening 76 in upper panel 72 of recycling center 10 will be received within bag 82 through opening 148 therein.

It can be appreciated due to the modular nature of the present design, multiple recycling centers may be positioned adjacent one another and interconnected. Further, it can be appreciated that the openings 76 in upper panel 72 of recycling center 10 may have any desired configuration. By way of example, referring to FIG. 6, openings 76 in upper panel 72 of recycling center 10 may take the form of elongated slots adapted for receiving sheets of paper therethrough. Additionally, it is contemplated for forward bag support 112 and rear bag support 114 to include multiple bag retainers 125 axially spaced along rods 120 thereof so as to allow multiple bags to be mounted on bag slide 106. Finally, it can be appreciated that first and second side panels 50 and 64 may be fabricated from a solid material, a mesh material or a transparent material. It can be appreciated that by fabricating first and second side panels 50 and 64 from a transparent or mesh material will allow for the simple and easy inspection of the interior of recycling center 10.

Various modes of carrying out the invention are contemplated as being within the scope of the following claims particularly pointing out and distinctly claiming the subject matter which is regarded as the invention.

The invention claimed is:

1. A recycling station receivable on a supporting surface, comprising:

first and second sidewalls, each sidewall including a forward edge, a rearward edge, an upper edge and an inner surface such that the inner surfaces of the sidewalls define a recycle receiving chamber;

a lid extending between the upper edges of the first and second sidewalls, the lid having an aperture therethrough;

a door pivotably connected to the forward edge of the first sidewall, the door movable between a first closed position and a second open position allowing access to the recycle receiving chamber; and a bag support slidably mounted within recycle receiving chamber and being movable between a first retracted position wherein the bag support is received within the recycle receiving chamber and an extended position wherein at least a portion of the bag support projects from the recycle receiving chamber, the bag support including:

a first rail slidably mounted to the first sidewall, the first rail having a forward end and a rear end;

a second rail slidably mounted to the second sidewall, the second rail having a forward end and a rear end;

a forward cross rail interconnecting the forward ends of the first and second rails; and a bag support bar having a first end interconnected to the forward cross rail at a location adjacent the first rail and a second end interconnected to the forward cross rail at a location adjacent the second rail;

wherein:

the door includes a transparent portion to allow an individual to view the recycle receiving chamber therethrough.

2. The recycling station of claim 1 wherein the first sidewall includes a panel having a transparent portion.

3. The recycling station of claim 2 wherein the second sidewall includes a panel having a transparent portion.

4. The recycling station of claim 1 further comprising a rear wall extending between the first and second sidewalls, the rear wall includes panel having a transparent portion.

5. The recycling station of claim 1 wherein the first sidewall includes indicia thereon.

6. The recycling station of claim 1 wherein the first end of the bag support bar is generally C-shaped and wherein the second end of the bag support bar is generally C-shaped.

7. The recycling station of claim 6 wherein the bag support bar and the forward cross rail lie in a common plane, the plane being at an acute angle to the supporting surface.

8. A recycling station, comprising:

a housing including first and second sidewalls and defining a recycle receiving chamber therein;

a door pivotably connected to the housing, the door movable between a first closed position and a second open position allowing access to the recycle receiving chamber; and a bag support slidably mounted within recycle receiving chamber, the bag support movable between a first retracted position wherein the bag support is received within the recycle receiving chamber and an extended position wherein at least a portion of the bag support projects from the recycle receiving chamber;

wherein the bag support includes:

a first rail slidably mounted to the first sidewall, the first rail having a forward end and a rear end;

a second rail slidably mounted to the second sidewall, the second rail having a forward end and a rear end a forward cross rail interconnecting the forward ends of the first and second rails; and a bag support bar having a first end interconnected to the forward cross rail at a location adjacent the first rail and a second end interconnected to the forward cross rail at a location adjacent the second rail.

9. The recycling station of claim 8 wherein the door includes transparent portion to allow an individual to view the recycle receiving chamber theretbrough.

10. The recycling station of claim 8 wherein the housing includes indicia thereon.

11. The recycling station of claim 8 wherein the first end of the bag support bar is generally C-shaped and wherein the second end of the bag support bar is generally C-shaped.

12. The recycling station of claim 11 wherein the bag support bar and the forward cross rail lie in a common plane, the plane being at an acute angle to a vertical plane.

13. A recycling station, comprising:

a housing including first and second sidewalls and defining a recycle receiving chamber therein;

a door pivotably connected to the housing, the door movable between a first closed position and a second open position allowing access to the recycle receiving chamber; and a bag support slidably mounted within recycle receiving chamber, the bag support including:

a first rail slidably mounted to the first sidewall, the first rail having a forward end and a rear end;

a second rail slidably mounted to the second sidewall, the second rail having a forward end and a rear end;

a forward cross rail interconnecting the forward ends of the first and second rails; and a bag support bar having a first end interconnected to the forward cross rail at a location adjacent the first rail and a second end interconnected to the forward cross rail at a location adjacent the second rail, the first and second ends of the bag support bar being generally C-shaped;

wherein the bag support bar and the forward cross rail lie in a common plane, the plane being at an acute angle to a vertical plane.

14. The recycling station of claim 13 wherein the door includes a transparent portion.

15. The recycling station of claim 13 wherein the housing includes indicia thereon.

* * * * *